United States Patent [19]

Ingham

[11] 3,942,462

[45] Mar. 9, 1976

[54] MARINE CRAFT STEERING ASSEMBLY

[75] Inventor: Michael J. Ingham, Epsom, England

[73] Assignee: Richmond Marine Limited, Twickenham, England

[22] Filed: Dec. 2, 1974

[21] Appl. No.: 528,665

[30] Foreign Application Priority Data

Dec. 4, 1973 United Kingdom ..... 56246/73

[52] U.S. Cl. ..... 114/165

[51] Int. Cl.[2] ..... B63H 25/06

[58] Field of Search..... 114/128, 130, 132, 144 R, 114/162, 164, 165, 167

[56] References Cited

UNITED STATES PATENTS

| | | | |
|---|---|---|---|
| 3,093,105 | 6/1963 | Rebikoff | 114/162 |
| 3,575,124 | 4/1971 | Alter | 114/165 |
| 3,728,983 | 4/1973 | Ingham | 114/165 |
| 3,731,645 | 5/1973 | Pearce | 114/162 |
| 3,752,105 | 8/1973 | Hackett | 114/162 |

*Primary Examiner*—Trygve M. Blix
*Assistant Examiner*—Stuart M. Goldstein
*Attorney, Agent, or Firm*—Baldwin, Wight & Brown

[57] ABSTRACT

A marine craft steering assembly comprises a rudder stock mountable on a craft for steering movements; a rudder blade mounted on the stock to partake of steering movements therewith and to swing relatively to the stock to a raised position if the blade encounters an obstruction. The blade is biased to its raised position, and a manually operable device, which may be a tiller, is cooperable with the blade for resisting swinging of the blade lower portion to the raised position and for swinging the blade from its raised position to its lowered position. The stock is releasably pivotally mountable on a craft hull and is locked in mounted position thereon by the aforesaid manually operable device movably mounted on the stock.

19 Claims, 4 Drawing Figures

7
31
6
II
II
3
37
39
38
33
12
28
21
26
16
15
34
10
17
25
8
13
36
4
22
24
9
5
III
III
35
19
27
23
11
14
8
IV
IV
34
1
30
32
40
II
2
20

MARINE CRAFT STEERING ASSEMBLY

This invention relates to a steering assembly for a marine craft such as a sailing dinghy and is a modification or improvement in the applicants' British Pat. No. 1,219,401.

In the applicants' earlier British patent a steering assembly is described in which longitudinal movement of the tiller in a rudder stock causes the rudder blade to be raised or lowered. In the particular construction described in that specification it was found that although the rudder blade could kick up if it hit an obstruction the precise operation was not satisfactory and the present invention was devised not only to provide better kick up action but also to develop a more convenient method of construction which would not only enable the various parts to be put together quickly and easily but would also provide easy handling when in use in a boat.

According to the present invention a marine craft steering assembly includes a steering tiller and a rudder blade which interact so that the rudder blade can be raised or lowered by longitudinal movement of the tiller, the rudder blade being pivoted to a rudder stock in which the steering tiller is supported and can slide, and resilient means for biasing the rudder blade towards the raised position.

Thus, with this construction the bias on the rudder blade assists in lifting it if it strikes an obstruction but the blade is maintained down by the position of the steering tiller in the rudder stock.

Preferably the resilient means are provided by a resilient leaf-spring which is bent to a loaded position when the rudder blade is moved to its lowered position.

The resilient leaf spring made be made of various materials such as a plastics material or metal such as a stainless steel.

In a preferred embodiment the rudder blade moves in a curved passage or channel in the rudder stock which extends around a pivot boss in which the resilient means are located.

Thus, the resilient means may be a leaf spring which is located in a slot in the pivot boss, part of the spring extending from the boss into the channel and being bent by the upper portion of the rudder blade when the blade is moved to its lowered position.

Conveniently the upper portion of the rudder blade is in the form of a curved arm having a free end, at least part of the inner surface of the arm being part circular and extending around the pivot boss.

With this construction the normal kind of pivot pin which is usually employed in lifting rudders is avoided and the larger radius of the pivot boss has certain advantages which will be discussed hereinafter.

Preferably the part circular part of the inner surface of the arm extends around an angle of more than 180°. With this arrangement the boss may be circular with a pair of diametrically opposed flats, the distance between the flats being slightly less than the width of the gap between the free end of the arm and the other end of the inner surface spaced away from it so that the blade can only be located on the boss by moving it transversely when it is in a position so that the flats are lined up with the gap and it cannot be removed from the rudder stock in any other position.

Preferably therefore the gap is arranged to be aft of the boss when the rudder blade is in the lowered position, and the flats extend in a horizontal direction. With this arrangement it is therefore necessary to insert the arm into the curved passage from aft and with the arm lower than the boss, that is with the rudder blade in the position in which it extends upwardly away from the rudder stack. This position which will never be achieved whilst the craft is in the water and the rudder blade will not therefore become detached due to floating up whilst in the water.

A portion of the rudder blade arm is conveniently arranged to be urged into engagement with the steering tiller by the resilient means, and to this end an abutment may be provided on the upper end of the upper part of the rudder blade which engages the end of the steering tiller.

In any case, the steering tiller may be carried in a bore in the upper part of the rudder stock.

Preferably the rudder stock is pivoted to the hull of the craft with which it is to be used by releasable means which are locked in position by the steering tiller. The rudder stock may be provided with two relatively vertically displaced extensions which are releasably located on relatively vertically displaced pivot members on the hull, the steering tiller extending along at least part of the upper extension.

With this arrangement the extensions can be provided with axially aligned circular openings which are located on the upper and lower pivot members which are respectively upwardly and downwardly projecting bosses, the tiller acting to locate the upper opening on the upper boss and to prevent the lower opening dropping below the lower boss.

In a convenient construction the upper and lower bosses are provided with means for attachment to the hull of the boat and they can be connected by a bar or tube.

The rudder stock is particularly suitable for manufacture from a plastics material.

The invention also includes a rudder stock for use with the steering assembly as set forth including means for carrying the rudder blade so that it can pivot and the steering tiller so that it can slide longitudinally and so that the steering tiller and rudder blade are in suitably spaced relationship to enable them to interconnect to operate as set forth and carrying resilient means to act on the rudder blade to bias it towards the raised position.

The invention may be performed in many ways but one embodiment will now be described by way of example and with reference to the accompanying drawings in which.

Figure 1:
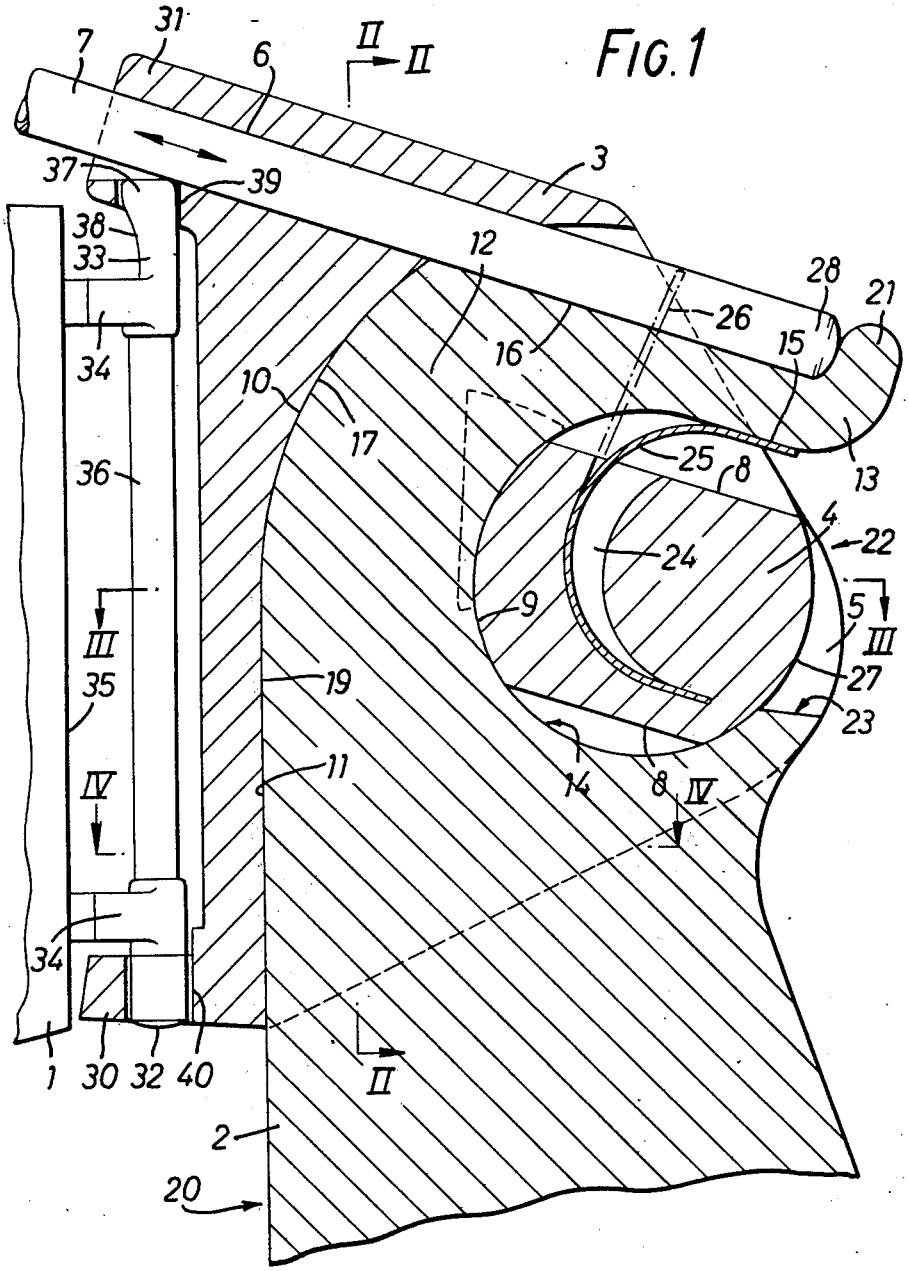
FIG. 1 is a fragmentary vertical longitudinal sectional side view of a marine craft steering assembly according to the invention.
Figure 2:
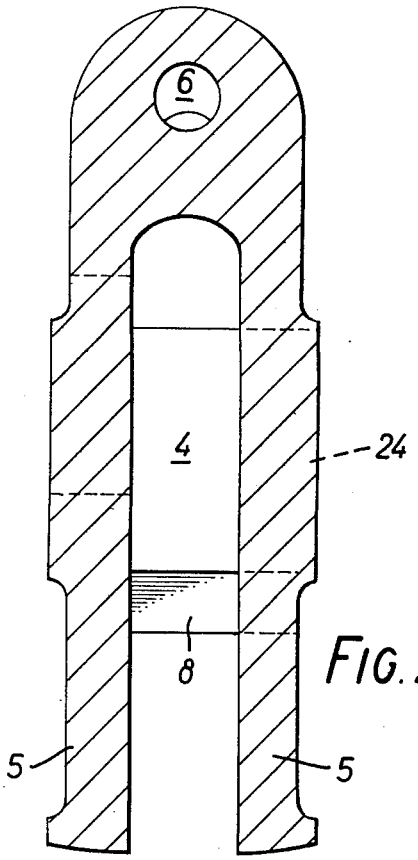
FIG. 2 is a vertical cross sectional view of the rudder stock shown in FIG. 1 on the lines II—II, the rudder stock being shown in FIG. 2 in complete cross section including the half section thereof which is not shown in FIG. 1 but which is opposite to and companion with the half section which is shown in FIG. 1, a rudder blade shown in FIG. 1 being omitted from FIG. 2.
Figure 3:
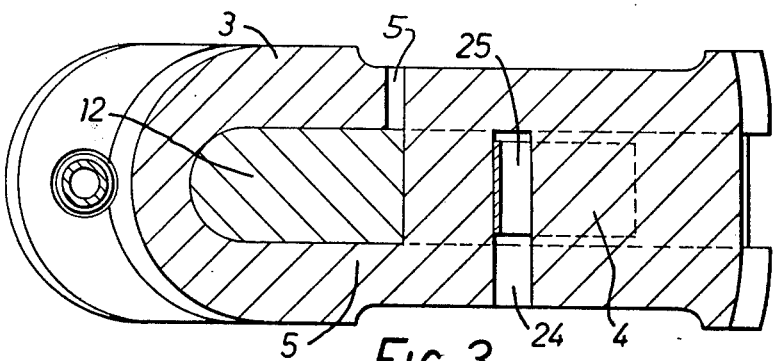
FIG. 3 is a horizontal cross sectional plan view taken on the line III—III in FIG. 1.
Figure 4:
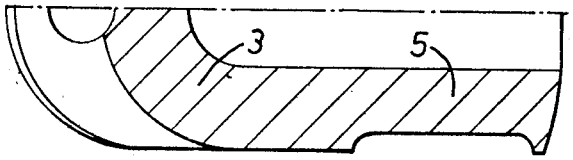
FIG. 4 is a horizontal cross sectional plan view taken on the line IV—IV of FIG. 1 but with the rudder blade removed, this view showing the half section of the rudder stock opposite to and companion with the half section of the rudder stock shown in FIG. 1.

As shown in the drawings a steering assembly is for a sailing dinghy the hull of which is indicated by reference numeral 1. The steering assembly comprises a rudder blade 2 which is pivoted to a rudder stock 3 by means of a pivot boss 4. The pivot boss 4 extends between spaced cheeks 5 of the rudder stock 3 so that the blade 4 can be rotated in relation to the stock between raised and lowered positions. The upper end of the rudder stock 3 is formed with a bore 6 which accepts a tubular steering tiller 7.

The pivot boss 4 is moulded integral with the rudder stock and is circular having a diameter greater than its axial length and with a pair of diametrically opposed flats 8, the distance between the flats being less than the diameter of the circular portion. This boss thus provides a curved passage or channel in the rudder stock two opposed side walls of the passage being provided by the cheeks 5 of the stock, one of the other walls being formed by a curved surface 9 and flats 8 of the boss and the other wall by a curved surface 10 and a substantially straight surface 11 in the stock. It will be seen from FIG. 1 that this curved passage extends around the pivot boss 4 and that the upper portion of the rudder blade 2 is in the form of a curved arm 12 which has a free end 13. Part of the inner surface 14 of the arm is circular and extends around the pivot boss 4 through an angle of approximately 200°. This part-circular portion terminates in an upper straight surface 15 which is tangential to the curved surface 14 and beneath the end 13 of the arm. The outer surface of the arm 12 has a flat upper portion 16 which is substantially parallel with the straight portion 15 and which terminates at one end in a curved surface 17 which is concentric with the surface 9 on the boss 4. This curved surface 17 leads to a substantially straight surface 19 which runs into the leading edge 20 of the rudder blade 2. The outer end of the surface 16 runs into an abutment 21 provided on the free end of the arm 13.

The gap indicated by reference numeral 22 between the end of the lower surface 15 and the free end 13 of the arm 12, considered together, and the end of the curved inner surface 14 terminating at a straight surface 23 which delineates the bottom of the gap is only slightly larger than the distance between the flats 8 and it will be seen that this gap is aft of the boss 4 when the rudder blade 2 is in its lowered position as shown in the drawings. A curved tapered slot 24 opens through one cheek 5 into the boss 4 and extends from the upper flat 8 of the boss and located in this slot is a leaf spring 25 made from a suitable plastics material or a metal such as stainless steel. One end of the spring nests in the lower end of the slot 24 and the upper end projects into the curved channel. The free position of the spring is shown in broken lines 26 in FIG. 1.

Before the blade 2 is mounted in the stock 3, the spring 25 is inserted in the boss slot 24 with one end of the spring nesting in the lower end of the slot and the other end of the spring extending as shown in broken lines at 26.

The rudder blade is then mounted in the rudder stock 3 by sliding it transversely over the boss 4 and between the cheeks 5 from aft with the rudder blade extending upwardly, that is rotated from the position shown in FIG. 1 counterclockwise in the general plane of the blade. In this position the free end 13 of the arm 12 is slid between the rudder cheeks until the curved surface 14 of the arm engages the rear surface 27 of the boss 4. The straight surface 23 at the end of the curved surface 14 is now dropped into the slot 24 in the boss 4 which aligns the axis of the curved surface 14 of the inner wall with the axis of the boss and enables the straight surface 15 of the arm 12 to pass beyond the end of the lower flat 8 so that the blade can be rotated in a clockwise direction as shown in FIG. 1 about the boss 4 until the free end 13 of the arm 12 engages the spring 26 and bends it to its biasing or loaded position as shown in full lines in FIG. 1. Provided the assembly is not inverted it can be carried in this position without the rudder blade and rudder stock detaching tehmselves from each other.

When the rudder stock is located on the boat in a manner hereinafter to be described, the tiller 7 is inserted rearwardly into the bore 6 until its end 28 engages the abutment 21 on the free end 13 of the arm 12. Further rearward movement of the tiller now causes the rudder blade to rotate clockwise around the boss 4 at the same time causing the spring 25 to bend until the fully lowered position of the blade 2 is reached as shown in FIG. 1. The friction between the tiller 7 and the walls of the bore 6 is sufficient to hold the tiller in this position against the action of the spring 25 which is now loaded thus biasing the rudder blade counterclockwise towards the raised position. Because the abutment 21 tends to lift the end 28 of the tiller as the abutment rotates forward, pressure to raise the blade thus increases the friction between the tiller and the wall of the bore 6. Should the leading edge 20 of the rudder strike an obstruction which is sufficient to overcome the friction betwen the tiller and the bore 6 the sping 25 will assist in lifting the rudder. Again, if the tiller is deliberately moved to the left as shown in FIG. 1 to permit the rudder blade to raise the spring will assist the water action in raising the rudder blade. When the assembly is removed from the boat with which it has been used the rudder blade will not immediately drop again because the spring will hold it in the position in which it extends substantially horizontally.

The rudder stock 3 is provided with two vertically displaced extensions 30, 31 which are releasably located on vertically displaced pivot members in the form of downwardly and upwardly directed bosses 32, 33 respectively. Each boss is moulded from a plastics material and has a location lug 34 by means of which it can be attached to the transom 35 of the boat hull 1. The bosses 32, 33 are joined by a bar or tube 36 of a suitable material such as aluminum or plastics material. The upper boss 33 has an enlarged head 37 which is formed by cutting back the boss below it at 38. The extension 31 is provided with a circular opening 39 and the lower extension 30 with an opening 40. The opening 39 extends upwardly into the bore 6. When it is desired to locate the rudder stock on the boat the opening 39 is placed over, that is above, the upper boss 33 with the stock tilted so that the lower extension 30 is displaced out of line with the lower boss 32. The rudder stock is then lowered until it is possible to tilt it slightly to allow the opening 40 to be aligned with the lower boss 32. The slight tilting is possible due to the cut-back 38 in the upper boss 33. The rudder stock is now raised so that the lower opening 40 is located on the lower boss 32 and the enlarged head 37 is located in the opening 39. The tiller 7 is now inserted into the bore 6 and rests on top of the enlarged head 37 which prevents the rudder stock from dropping and maintains the rudder stock on the bosses. When it is desired to remove the rudder stock it is merely necessary to completely withdraw the tiller 7 until it is clear of the upper boss 38 and the process is reversed.

The complete assembly is particularly attractive to a manufacturer because the only parts which have to be put together on assembly prior to inserting the blade 2 into the stock 3 are the spring 25 and the stock and this is simply achieved by pushing the spring into place until it wedges in the lower end of the slot 24. The rudder stock can be moulded in a single operation and broken parts can thus easily also be replaced.

What I claim is:

1. A marine craft steering assembly comprising a rudder stock adapted to be mounted on a marine craft for substantially horizontal steering movements; a rudder blade mounted on said stock with a lower portion of said blade projecting below said stock, the mounting of said blade on said stock constraining said blade to partake of the steering movements of said stock and enabling said blade to swing in one direction to move said lower portion rearwardly and upwardly relatively to said stock and in the opposite direction to move said lower portion downwardly and forwardly relatively to said stock, whereby said blade may yield and swing in said one direction to move said lower portion rearwardly and upwardly to a raised position if said lower portion encounters an obstruction when said assembly is in forward motion in the water; biasing means mounted on said stock and biasing said blade to swing the latter in said one direction to move said blade lower portion rearwardly and upwardly to said raised position to clear the obstruction; and manually operable means cooperable with said blade for swinging the latter in said opposite direction to move said blade lower portion to a lowered position.

2. A steering assembly according to claim 1 in which said stock is provided with means for mounting said stock on a craft for steering movements about a substantially vertical axis and in which the mounting of said blade on said stock is provided by pivot means on said stock engaged by said blade for swinging of the latter about a substantially horizontal axis.

3. A steering assembly according to claim 1 in which said biasing means is a spring interposed between and engaging both said stock and said blade.

4. A steering assembly according to claim 3 in which said pivot means comprises a boss and said blade has an internally curved surface engaging said boss, the latter being formed with an internal slot into which a portion of said spring extends, another portion of said spring projecting beyond said slot and bearing against a part of said blade to the rear of said substantially horizontal axis when said blade is in its lowered position.

5. A steering assembly according to claim 3 in which said spring is a leaf spring which is bent to loaded position by engagement with said blade when said blade lower portion is in said lowered position.

6. A steering assembly according to claim 1 in which said manually operable means comprises a tiller mounted on said stock for effecting said horizontal steering movements, said tiller being movable relatively to said stock for transmitting motion to said blade to swing the latter in said opposite direction against the bias of said biasing means.

7. A steering assembly according to claim 2 in which said manually operable means comprises a tiller mounted on said stock for effecting said horizontal steering movements, said tiller being movable relatively to said stock for transmitting motion to said blade to swing the latter in said opposite direction against the bias of said biasing means.

8. A steering assembly according to claim 7 in which an upper portion of said stock above said pivot means thereon is provided with means frictionally engaging said tiller for yieldably resisting movement of said tiller relative to said stock and thereby resisting movement of said blade in said one direction by said biasing means.

9. A steering assembly according to claim 6 in which the upper portion of said stock is formed with a bore, said blade is formed with an abutment, and said tiller is longitudinally slidable in said bore with one end of said tiller extending forwardly beyond said bore for being grasped by a helmsman and the other end of the tiller engaging said blade abutment to transmit motion to said blade as set out in claim 6.

10. A steering assembly according to claim 9 in which said biasing of said blade is in a direction to press said tiller laterally of said bore to cause said tiller to engage the bore wall frictionally and thereby resist movement of said blade in said one direction by said biasing means.

11. A steering assembly according to claim 3 in which said stock is formed internally with a curved passage and in which said pivot means comprises a boss extending horizontally within said passage, said blade being mounted within said passage and having an internally curved surface pivoted on said boss, said boss having a slot in which said spring is mounted, a portion of said spring extending outwardly from said slot and engaging said blade.

12. A steering assembly according to claim 11 in which said blade has an arm which extends above said boss when said blade lower portion is in its lowered position, said arm having a free end, and in which said manually operable means engages said arm free end.

13. A steering assembly according to claim 12 in which said stock is formed with a fore-and-aft extending bore above said boss, said arm free end has an abutment, and said manually operable means comprises a tiller slidable in said bore and having one end engaging said abutment.

14. A steering assembly according to claim 11 in which said boss is in part circular and has two diametrically opposed flats, said internally curved surface of said blade engages the circular part of said boss, and said internally curved surface has a circumferential gap of greater width than the distance between said flats whereby to enable said gap to be passed over said boss to position said internally curved surface to surround said boss.

15. A steering assembly according to claim 14 in which said internally curved surface extends through an angle of more than 180°.

16. A steering assembly according to claim 14 in which said flats extend substantially horizontally and in which said gap is aft of said boss when said blade lower portion is in its lowered position.

17. A steering assembly according to claim 1 including first pivot means adapted to be attached to a craft hull; and companion pivot means on said stock releasably pivotally connected to said first pivot means, said manually operable means comprising a tiller removably mounted on said stock and, when mounted thereon, locking said companion pivot means against being released from said first pivot means.

18. A steering assembly according to claim 17 in which said first pivot means comprises an upwardly extending pivot member and therebelow a downwardly extending pivot member, and in which said companion pivot means comprises an opening in the upper part of said stock engageable with said upwardly extending pivot member, and an opening in the lower part of said stock engageable with said downwardly extending pivot member.

19. A steering assembly according to claim 18 in which said stock is formed with a substantially horizontal bore which extends above said opening in the upper part of said stock, and in which said tiller is slidable in said bore from a position displaced from being over said opening in the upper part of said stock to a position over said opening in the upper part of said stock in which latter position said tiller locks said companion pivot means against being released from said first pivot means.

* * * * *